US006109766A

United States Patent [19]

Baliozian

[11] Patent Number: 6,109,766

[45] Date of Patent: Aug. 29, 2000

[54] LIGHTING DEVICE

[76] Inventor: Mardick Baliozian, 175 E. Delaware, Apartment 4717, Chicago, Ill. 60611

[21] Appl. No.: 09/154,659

[22] Filed: Sep. 18, 1998

Related U.S. Application Data

[63] Continuation-in-part of application No. 08/871,180, Jun. 9, 1997.

[51] Int. Cl.[7] ..... F21V 19/02; F21V 14/02

[52] U.S. Cl. ..... 362/287; 362/233; 362/239; 362/247; 362/250; 362/285; 362/241; 362/346; 362/419

[58] Field of Search ..... 362/233, 238, 362/239, 247, 250, 285, 287, 372, 418, 419, 228, 241, 297, 341, 346, 348, 349

[56] References Cited

U.S. PATENT DOCUMENTS

| | | | |
|---|---|---|---|
| 926,082 | 6/1909 | Taylor et al. | 362/228 |
| 981,046 | 1/1911 | Welles | 362/228 |
| 1,124,051 | 1/1915 | Matisse | 362/287 |
| 3,590,238 | 6/1971 | Arens | 362/285 |
| 3,886,350 | 5/1975 | Katsukura et al. | 362/287 |
| 4,386,391 | 5/1983 | Gulliksen et al. | 362/372 |

*Primary Examiner*—Alan Cariaso
*Attorney, Agent, or Firm*—Rockey, Milnamow & Katz, Ltd.

[57] ABSTRACT

A lighting device comprising one or more light sources placed in respect to a concentrating concave or echelon main reflector, with the light emitted by the light source(s) being reflected by the main reflector so as to create a projected pattern of light to be directed onto a subject to be illuminated, a focusable light being achieved by shifting means capable of displacing or tilting the light source(s) with regard to the optical axis of the reflector. Said shifting means are apt to displace said at least one light source in a direction or at an angle to and from said optical axis of said reflector, in a plane substantially perpendicular to said axis, or to tilt the at least one light source(s). The light source(s) is(are) placed around said optical axis of the reflector and are movable or inclinable in a direction away from the optical axis of said reflector.

36 Claims, 4 Drawing Sheets

LIGHTING DEVICE

This appln is a C-I-P of Ser. No. 08/871,180 filed Jun. 9, 1997.

BACKGROUND OF THE INVENTION

The invention is relative to the field of lighting in which lighting devices or luminaires are used comprising one or several light sources placed in regard to a reflector to illuminate directly a subject, e.g. in luminaires used in television studios.

Such reflector light sources are well known which furthermore concentrate or focus the light, thus changing the angle lit. This an be achieved in several different ways.

The most common lighting device of this kind is provided with shifting means for moving backwards or forwards longitudinally along its optical axis the light source placed within the reflector so as to vary the projected pattern of light. However, such lighting devices present the following disadvantages:

When the light source is advanced to a maximum degree, the end of the lamp may protrude forward thus exposing it to potential breakage. Also a percentage of light emitted by the light source is consequently lost since it is no longer captured and reflected by the reflector. Furthermore, the light source may come in contact with accessories attached to the front of the reflector.

The housings and focusing systems of the lighting device must be made large in size in order to permit the above mentioned movement.

When the light source is moved backwards, it goes beyond the rear limit of the reflector, causing an increasing amount of light to be wasted since the reflector no longer receives this light and, therefore, cannot reflect it forward as desired.

When a small-size light source is used and when a wide-angle light pattern is desired, there is a "hole in the middle" since no light is reflected there.

Light devices have also been made with two light sources mounted eccentrically within a reflector and rotated around the optical axis of the reflector. The use of this type of fixture is very limited, due to the light pattern variation always being projected co-axially in the same fashion, in an uneven manner around the optical axis.

A variation of this type of lighting device has been made in which the rotational movement of two light sources is coupled to a longitudinal movement of them backwards and forwards along the optical axis of the reflector, so that the light can be more or less focused. However, its utility is extremely limited.

Lighting devices having multi-filament lamps have also been used. The filaments are in this case placed physically at different fixed places within the lamp so that the surrounding reflector receives the light coming from different angles, thus projecting the light forward in a different manner. This system has certain disadvantages and limitations and except for automobile head lights, this system is rarely used since:

Special multi-filament lamps must be used.

The light pattern is limited and fixed by the above number of filaments within the lamp and their placement.

It is not continuously variable.

Another type of lighting device uses a reflector that has two separate sections with the same optical axis. A lamp is used in each level of the reflector and each section has different optical characteristics and diameter. So by switching on one lamp or the other, or both, the lighting effect changes. However, this device is rather complicated to produce and rather limited in use.

Clusters of light sources placed around the optical axis of a reflector are also known, but such systems if focusable, do so by changing reflectors or by moving the lamps backwards and forwards longitudinally along the optical axis.

Also fixed focus lighting fixtures are known in which the lamp is inserted and held at an angle to the optical axis, so as to have its base outside the reflector at the side rather than to the rear with the light emitting surface of the lamps placed along the optical axis of the reflector in a fixed position. So there are no means to vary the light.

Fixed ceiling lights in the 60 cm×60 cm size range exist, but the angle they light and the direction of the light cannot be changed. Attempts are made to get around this deficiency by placing in front of certain models, expensive known elements such as light absorbing gridspots to reduce the angle lit, and light reflecting grid elements to reflect light to the side at a fixed angle. These accessories are inefficient, expensive, and non-adjustable.

The banking together of a number of lights is well-known and much used, but all existing such fixtures are made up of simply a series of individual, non-adjustable lights, mounted side to side. So the angle lit by these arrays of lights is not adjustable, and the lack of the use of additional mirror reflecting surfaces common for all the lights, means that there is no increase in light output and there is no mixing of the light by these mirror surfaces.

SUMMARY OF THE INVENTION

This invention is relative to a lighting device which overcomes the disadvantages of the prior art lighting devices.

Specifically, this invention is directed at making a lighting device using one main reflector and which is capable of varying the projected pattern of light either symmetrically or asymmetrically, and to do this without moving the light source(s) backward or forward longitudinally in the direction of the optical axis of the reflector or by rotating them around the optical axis of the reflector. As there is no backward and forward movement of the light source, the depth of the luminaire can be minimized. Furthermore, the light source(s) is(are) allowed to be moved without interference from the accessories placed on its front face.

The lighting device made according to the invention makes it possible to have a focussable light having a variable angle from less than 30° to over 100° with a very high light output and efficiency. When used with fluorescent lamps, the lighting device of the invention achieves up to or even more than 100 Candelas per watt vs. 10 to 30 Candelas per watt being attained by other presently being made fluorescent lamp devices, which in addition are not focusable.

The lighting devices made according to this invention can be used with one or more light sources which are placed in a position to illuminate a concentrating concave or echelon reflector. Individual reflectors for each light are not needed. It is also possible to have interchangeable lightheads and interchangeable reflectors.

Furthermore, with the invention, normal lamps can be used instead of special "bi-focal" or "multi-focal" lamps.

The lighting device according to the invention comprises at least one light source placed in a position to light a main reflector. The light emitted by the light source is reflected by the reflector so as to create a projected pattern of light to be directed onto a subject to be illuminated with, a focusable light being achieved by shifting means capable of displacing or tilting said at least one light source with regard to an optical axis of the reflector.

According to an important aspect of the present invention, the shifting means are apt to displace said at least one light source in a direction to and from said optical axis of said reflector, in a plane substantially perpendicular to said axis.

According to a specific embodiment of the invention, at least two light sources are placed around said optical axis of the reflector and being movable in a radial direction with regard to the optical axis of said reflector.

Preferably, the light sources are regularly placed around said optical axis of the reflector.

According to an other embodiment of the invention, a fixed light source is placed in the optical axis of said reflector, and used in conjunction with other movable or tiltable light sources.

According to a further embodiment of the invention, the device comprises at least two light sources and said shifting or tilting means which are capable of moving or tilting simultaneously said light sources.

According to a further embodiment of the invention, the lighting device comprises at least two light sources and said shifting means are capable of moving or tilting separately the light sources.

According to a further aspect of the invention, the shifting means comprise a guide plate having at least one guide slot through which passes an extension of the base of said at least one light source, a cam plate being placed under the guide plate and having at least one cam cooperating with a light source base, the guide plate and the cam plate being capable of a relative rotating movement so as to displace the base of said light source base in said direction to an from the axis of said reflector.

According to a further aspect of the invention, the guide slots of said guide plate are rectilinear slots extending radially from the optical axis of said reflector and the cams of the cam plate are curved.

According to a further aspect of the invention, the cams of the cam plate are slots.

According to a further aspect of the invention, the light source base is separated into different sections each for groups of one or more light sources, and the shifting means are used to control the tilting of each section which is inclinable to and from the optical axis of the reflector. Different means for controlling the tilting angle exist enabling the user to change the light pattern by varying the angle for instance by: turning a knob; operating a lever, or by an electric motor.

According to a further aspect of the invention, the device comprises at least two light sources of different nature such as incandescent halogen lamps, high frequency, fluorescent tubes, discharge lamps, electronic flash tubes.

According to a further aspect of the invention, the housing in which the shifting means are placed can be separated from said reflector in order to be replaced by an other housing with a different set of light sources or to use different interchangeable reflectors with the same lighthead.

Other features, advantages and objects of this invention will become apparent from the following description of embodiments of the invention taken in conjunction with the figures.

DESCRIPTION OF EMBODIMENTS OF THE INVENTION

Figure 1:
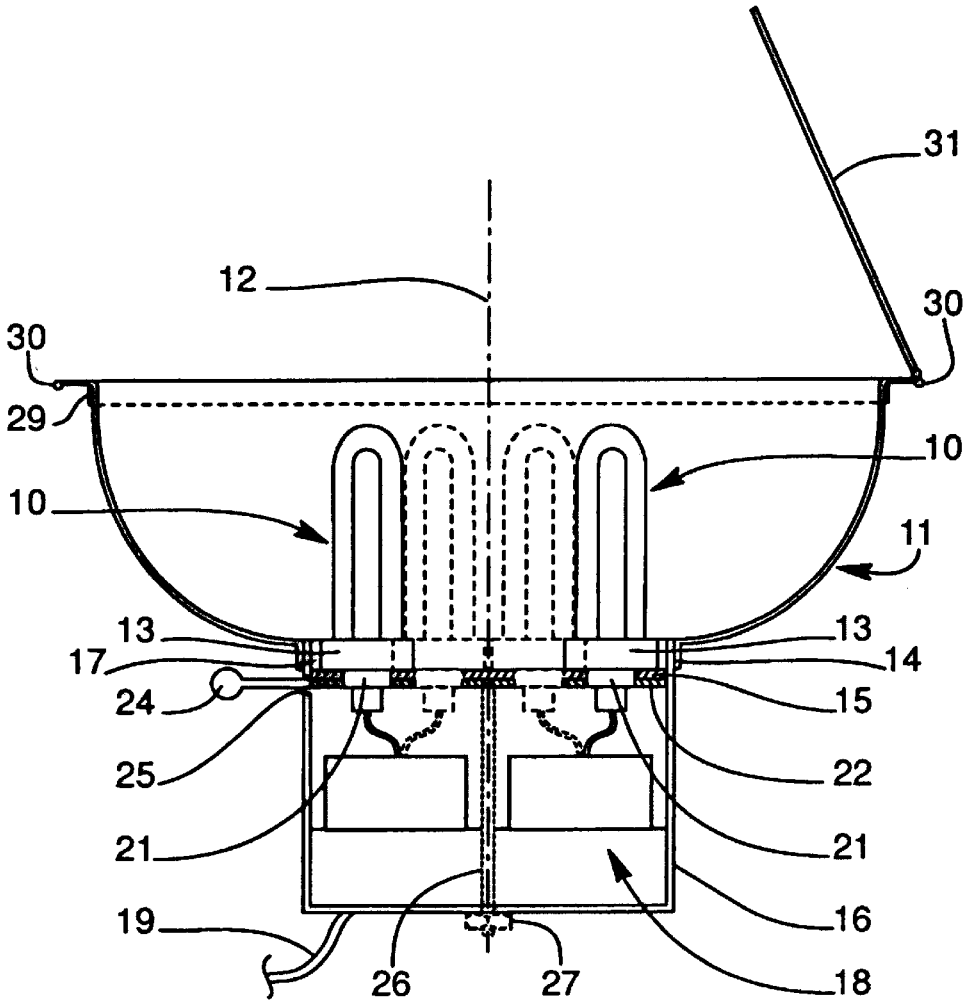
FIG. 1 is a schematic cross section view of a first embodiment of the invention with two light sources.
Figure 2:
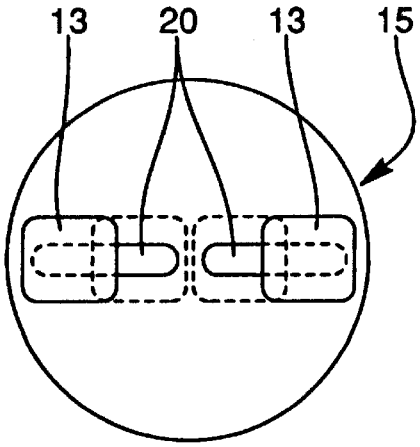
FIG. 2 is a schematic top view of a guide plate of shifting means of the two light sources of FIG. 1.
Figure 3:
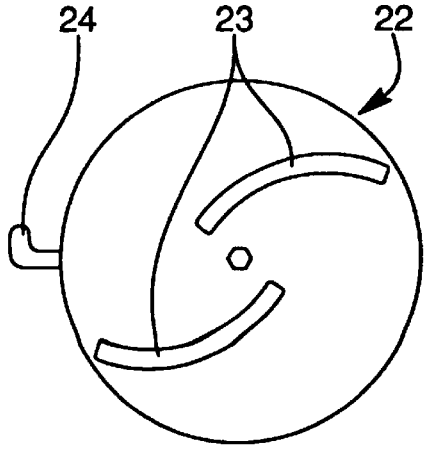
FIG. 3 is a schematic top view of a cam plate of shifting means of the two light sources of FIG. 1.

FIGS. 1–3 show a first embodiment of the invention. The lighting device shown comprises two light sources 10 in form of U-shaped light tubes which are placed inside a reflector 11, on opposite sides of the central optical axis 12 of this reflector.

The bases 13 of the lights sources 10 are disposed in a central opening 14 of the reflector on a base plate 15 constituting the front side of a housing 16 of the lighting device. The base plate 15 and the housing 16 have preferably a cylindrical form and the cylindrical side wall of the housing is extending above to base plate 15 so as to form a circular space 17 in which the bases of the light sources are disposed so that their light emitting parts start from a point near the level with the reflector opening.

The housing 16 preferably contains the electronic circuitry, ballasts and power supplies 18 of the lighting device. A main electrical input has the reference number 19 in FIG. 1.

The lighting device further comprises shifting means capable of displacing the light sources 10 with regard to the optical axis 12 of reflector 11.

For that purpose, the base plate 15 contains according to an embodiment of the invention rectilinear guide slot 20 (FIG. 2) constituting a guide plate for the lamp or tube bases 13 which are provided with an extension 21 passing through the slots. The dimension of this extension 21 is adapted to the width of the slot to insure an easy displacement of the extension along the slot.

The slots 20 are radially displaced and preferably but not necessarily aligned so as to face each other on opposite sides of the optical axis 12 of the reflector 11 and they move outward in a perpendicular manner to this axis 12. Consequently, the tube bases 13 can be displaced in these guide slots 20 in a direction to and from the optical axis of the reflector, in a plane substantially perpendicular to this axis.

The shifting means further comprises a cam plate or disc 22 disposed immediately under the guide plate 15 in the housing 16 where it is mounted so as to be able to rotate around an axis which coincides with the longitudinal axis of the housing. The cams are in this embodiment in form of two curved slots 23, but they could of course as an alternative be in form of grooves made on the side of the cam disc facing the guide plate 15. The cams could also be constituted by additional guides attached to the cam disc 22.

Each curved slot 23 has one of its ends near the center of the cam disc 22, whereas the opposite end is near to the periphery of the disc depending on the desired amount of movement.

The extensions 21 of the tube bases 13 extend into the cam slots 23 so as to be moved along the cam disc when this latter is rotating. The width of the cam slots 23 are adapted to the dimension of the extensions 21 so as to facilitate their sliding in the slots.

For controlling its rotation, the cam disc 22 is coupled to an arm 24 protruding from the housing through an oblong opening 25 in the wall. The shifting means according to this embodiments works as follow.

FIG. 2 shows in solid lines the position where the light sources bases 13 are in their end position near to the periphery of the guide plate 15 and in broken lines the position where they are in their end position near to the center of the plate 15. They are moved from the first position to the second by rotating the cam disc in FIG. 3 and can of course take any intermediary position.

By moving the light sources to and from the optical axis of the reflector, the angle of incidence of the light rays hitting the reflector changes, thus changing their angle of reflectance. Hence, it is possible to direct the light rays to different places in space by varying the placement of the light sources on the guide base plate 15. Also as a light source approaches the reflector surface, it subtends a bigger angle causing its angle of reflectance to increase. These facts are used in the invention to create a new, versatile and efficient luminaire.

For use in television studios where the lights are hung from above, the control means for displacing the light sources within the reflector is advantageously operated by a pole which is manipulated from the floor.

FIG. 1 also shows in broken lines alternative control means of the cam disc 22. They comprise a central shaft 26 connected with the disc 22 and having one end attached to a turning knob 27 placed outside the housing 16.

For use in television studios, the turning knob 27 can in the above mentioned case be operated by means of a cardan or universal joint to which is attached a turning cup.

It would of course be possible to have another type of shifting means as e.g. a cone, the top of which enters between slidingly mounted and spring biased light source bases so as to displace the bases toward a peripheral position when penetrating further between the bases.

Other shifting means, including individual manual means, could also be provided so as to move the light sources independently of each other.

Figure 4:
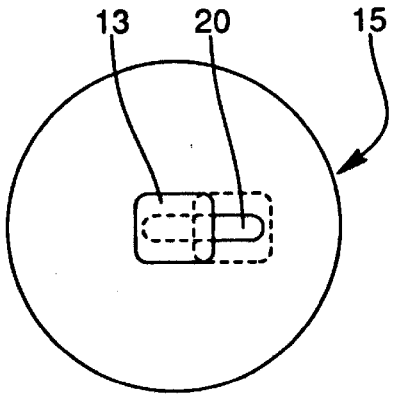
FIG. 4 is a schematic top view of a guide plate of shifting means of a second embodiment having only one light source.
Figure 5:
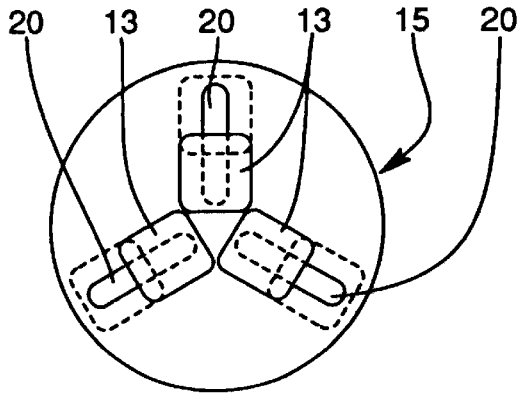
FIG. 5 is a schematic top view of a guide plate of shifting means of a third embodiment having three light sources.
Figure 6:
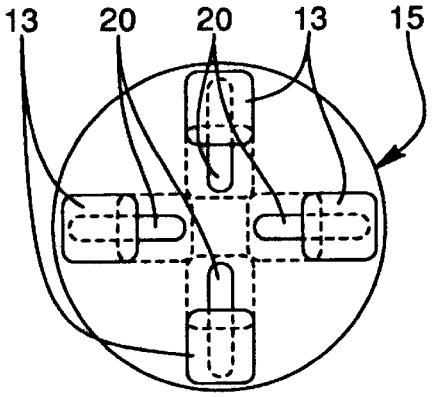
FIG. 6 is a schematic top view of a guide plate of shifting means of a fourth embodiment having four light sources.
Figure 6A:
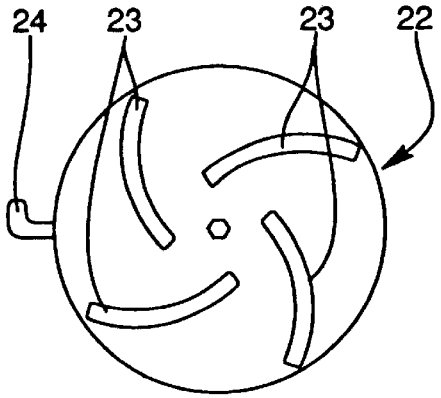
FIG. 6A is a schematic top view of a cam plate of shifting means of four light sources.

FIGS. 4–6 show some alternative embodiments having the same type of shifting means as the embodiment already described, but with a various number of light sources.

In FIG. 4, bases 13 of one single light source can take a position either in the optical axis of the reflector or be moved along a radially extending guide slot 20 toward the periphery of the guide plate 15. In FIGS. 5–6, there are 3 respectively 4 light sources guided in regularly disposed radially extending guide slots 20 on the guide plate 15.

The movement of the light sources disposed as indicated in FIGS. 5 and 6 should be limited to where a "hole in the middle" appears so as to insure a homogeneous lighting pattern.

Figure 7:
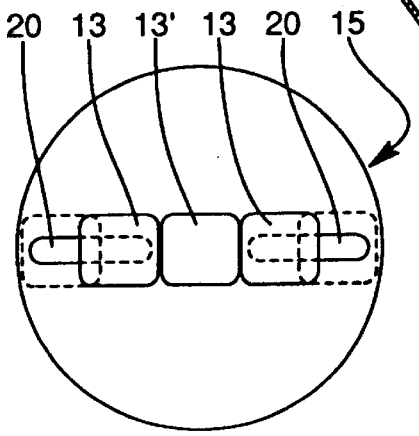
FIG. 7 is a schematic top view of a guide plate of shifting means of the two light sources of FIG. 1 combined with a centrally placed fixed light source.

To eliminate this "hole in the middle", FIG. 7 illustrates an advantageous embodiment with a light source having its base 13' centrally placed in a fixed manner in the central optical axis of the reflector 11. In the shown arrangement, two radially movable light source bases 13 are disposed on opposite sides of the fixed light source. Such an arrangement increases the total amount of light and also permits laterally placed light sources to be moved further away with regard to the optical axis of the reflector 11 in order to obtain a wider lighting angle, without creating a "hole in the middle" which has less light.

Of course, such a centrally fixed light source could be used with any number of movable light sources. In tests carried out by the applicant, up to 8 light sources have been used with success.

A lighting device made in this manner, using a single row of light sources such as shown in FIGS. 2 and 7 will thus permit the light pattern to be made in a linear manner. This is especially advantageous whenever one wishes to light up backgrounds in studios or for lighting several people sitting in a row, such as at a News Desk. This also permits them to be lit without changing the lighting effect used on the set behind them, since if they are being lit in a horizontal manner, there will be little light falling on the scenery behind them, and no light is wasted by falling on the floor below their desk.

Furthermore, the housing 16 is advantageously mounted to the reflector 11 by quick release means such as a latching device to make it possible to have interchangeable housings provided with shifting means according to the invention.

Figure 8:
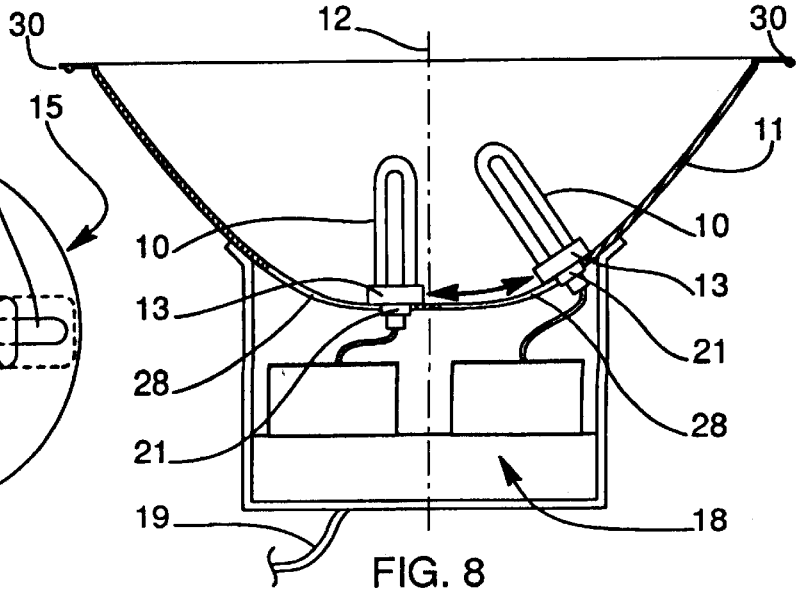
FIG. 8 is a schematic cross section view of a fifth embodiment of the invention with two light sources guided directly along the wall of the reflector.

FIG. 8 shows another embodiment of the invention without any base plate on which the light source bases can move. In this case, the extensions of the light source bases are placed in slots 28 made directly in the wall of the reflector 11. The slots 28 extend outwards in the reflector in a plane which is substantially perpendicular to its optical axis 12.

The light source bases are attached to simple shifting means like e.g. push-and-pull and locking devices which are well known to one skilled in the Art.

The lighting device according to the invention makes it possible to use combinations of different kinds of light sources such as incandescent halogen lamps, fluorescent tubes powered by either low frequency or high frequency ballasts, discharge lamps of different kinds, electronic flash tubes.

Since additional means of controlling the light are often desirable, mounting means are provided for using different accessories.

These means for mounting can comprise a ridge 29 incorporated into the reflector 11 to hold gridspots, diffusers, colour filters, prismatic refracting light intensifiers. An outer lip 30 of the reflector 11 can be provided to hold different accessories such as pivoting barn doors 31, clip-on colour filters, clip-on light reflecting intensifiers. The mounting means may also comprise a ring for linking reflectors together in either a 45° or 60° manner or for attaching either an extra large size reflector or lightbox.

Means can also be provided either on reflector 11 or on the rear housing 16 to attach an L-shaped or U-shaped yoke for holding and tilting the lighting device in a conventional manner or for the holding of the lighting device on a flexible goose-neck or pan-tilt mount.

FIGS. 9 through 14 show another embodiment of the invention in which the lighting angle is varied by inclining the light source(s) instead of varying the distance of their bases from the optical axis of the reflector. If desired this system can be combined with the previously described one.

This system has numerous advantages. It is cheaper to manufacture since it is simpler and uses fewer parts, and it avoids having a "hole in the center" lighting effect. The lamp bases 13 remain in fixed positions in their respective difference sections of lamp base 15. These separate sections are then inclined with respect to the optical axis 12 of the reflector.

Figure 9:
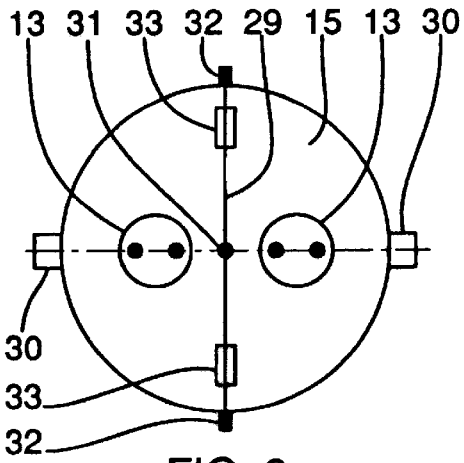
FIG. 9 is a schematic front view of a base plate for two inclinable light sources in a sixth embodiment of the invention.
Figure 15:
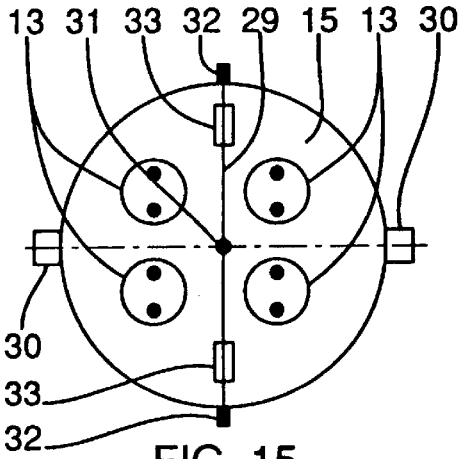
FIG. 15 is a schematic front view of a base plate with two inclinable sections each with two light sources of an eighth embodiment of the invention.

FIG. 9 is a schematic top view as shown in FIG. 15 of a base plate 15 divided along line 29 into two sections, shown with one lamp base 13 on each section. However, two or more lamps can be placed per section. Each section has means 30 for holding it within the housing enclosing it. The angle of the sections with respect to the optical axis of the reflector is controlled either by keeping the center axis or point in place and by moving backwards and forwards the outer edges of the base plate 15, or by keeping the outer edges in place and by moving backwards and forwards the center axis or point of the base plate.

The individual sections are linked together by a hinging means such as a hinge 33, or base plate 15 can be made of a single plastic plate with a flexible section along line 29 so as to serve as a hinge. The different sections can also be separate parts held together by a center piece 31 onto which a shaft 35 can be attached which permits their respective angle to be changed when shaft 35 is moved backwards and forwards.

Figure 10:
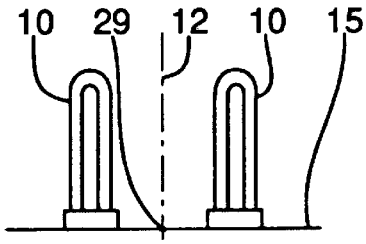
FIG. 10 is a schematic side view showing the two inclinable light source of FIG. 9 in their flat position.

FIG. 10 is a side schematic view showing the two sections of base plate 15 in a flat position with lamps 10 parallel.

Figure 11:
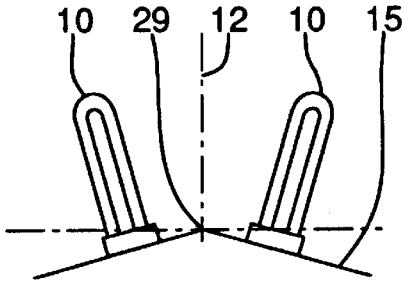
FIG. 11 is a schematic side view showing the two inclinable light sources of FIG. 9 in their diverging, wide angle position.

FIG. 11 is a side schematic view showing the base plate 15 with its sections in a diverging wide angle position. In this configuration lamps 10 are pivoted further away from the optical axis of the reflector, and are closer to the reflector 11 (FIG. 13), thus subtending a bigger angle. So the angle lit by the reflector is increased.

Figure 12:
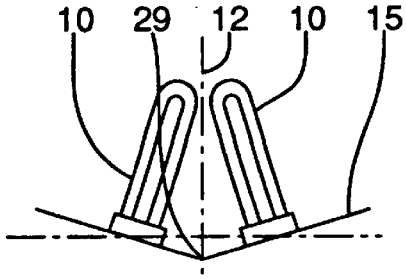
FIG. 12 is a schematic side view showing the two inclinable light sources of FIG. 9 in their converging, concentrated, narrow angle position.

FIG. 12 is a side schematic view showing the base plate 15 with its sections in a converging concentrated position. Thus lamps 10 are closer together forming a smaller size light source which is closer to the optical axis of the reflector and deeper within the reflector, causing an increase of light of light over a smaller angle.

Figure 13:
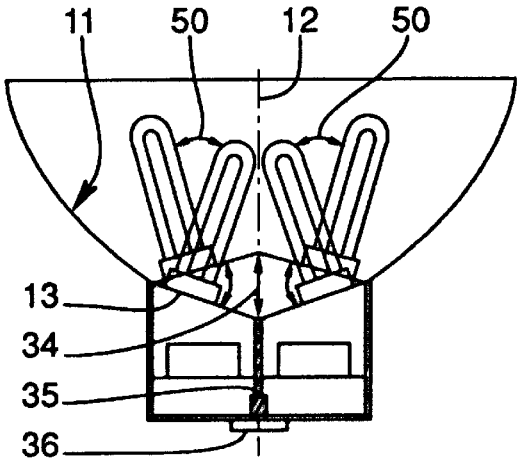
FIG. 13 is a schematic cross section view showing the angular variation of the tilting of the light sources within the reflector and the placement of a centrally placed control shaft of the sixth embodiment of the invention.

FIG. 13 is a schematic cross section view depicting the tilting movement of the lamps 10. Generally a ±15° movement 50 of the lamps suffices, but this can vary depending on the placement of the lamps on base plate 15, the length of the lamps, the angle variation sought, the design of the reflector, etc. The movement necessary for the desired angle variation is advantageously obtained by moving the center of base plate 15 in the direction of arrow 34 and controlled for example by axis 35 and by turning knob 36 or by an electric motor (not shown) or by a lever similar to lever 24 of FIG. 1 attached to axis 35, or by moving center axis 29 in and out by using points 32 as in FIG. 15 or FIG. 9.

Figure 14:
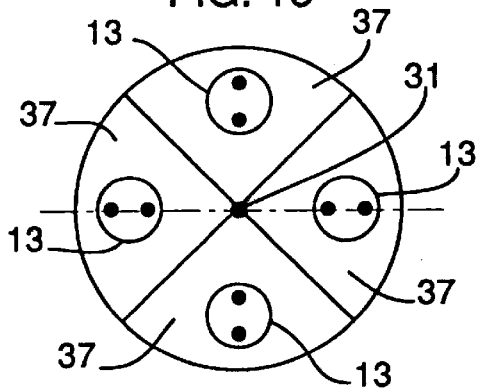
FIG. 14 is a schematic front view of a base plate for four inclinable light sources of a seventh embodiment of the invention.

FIG. 14 is a schematic top view of a base plate with four lamp sockets 13 designed for holding four lamps 10, with individual sections 37 for each lamp. This type of base plate gives a variation in the angle lit that is symmetrical. Other base plates can be designed for use with other quantities of lamps. The individual sections are held in place like the examples previously given and their angle similarly controlled.

FIG. 15 is a schematic top view of a base plate divided into two sections in which two lamp sockets 13 are placed on each section whose angle can be varied. This version differs from FIG. 14 in that when the lamps are tilted, more variation in the angle lit occurs in one plane compared to the other.

Figure 16:
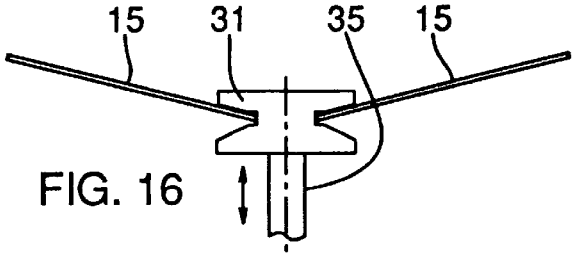
FIG. 16 is a schematic side view of a center holding piece for inclinable sections in the sixth or seventh, or eighth embodiment of the invention.

FIG. 16 illustrates with a side elevation view one version of the holding end of the control shaft attached to the center of base plate 15. This piece holds all of the sections in place at their center points, while permitting them to be tilted backwards and forward by control shaft 35.

Figure 17:
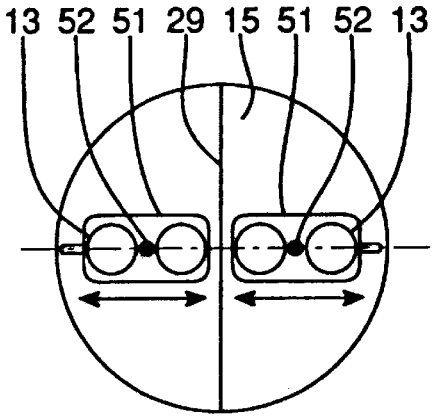
FIG. 17 is a schematic front view of a two section inclinable base plate with two lamps on each section placed in a horizontal configuration and movable in a horizontal direction in a ninth embodiment of the invention.
Figure 18:
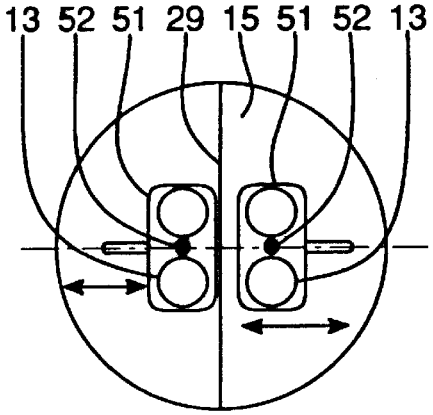
FIG. 18 is a schematic front view of a two section inclinable base plate with two lamps on each section placed vertically on each section and movable horizontally, similar to FIG. 17.

FIGS. 17 and 18 show another version of how lamp sockets 13 can be mounted on base plate 15. Two or more lamp sockets 13 are mounted on plates 51 which in turn can be mounted and rotated around point 52. FIG. 17 shows the lamp aligned horizontally while FIG. 18 shows the lamps in vertical position moved closed to each other by their lateral movement. These rotating plates 51 can also be used with the previously described base plates designed to be inclined along axis 29.

Figure 19:
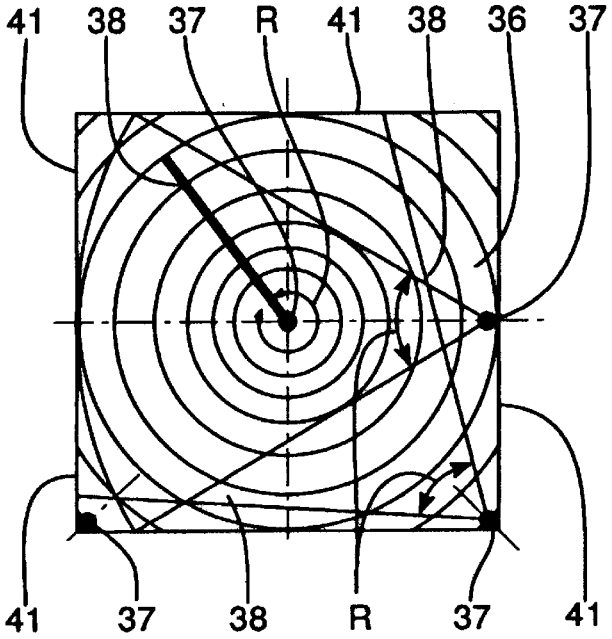
FIG. 19 is a front schematic view of a tenth embodiment of the invention using an echelon reflector.
Figure 20:
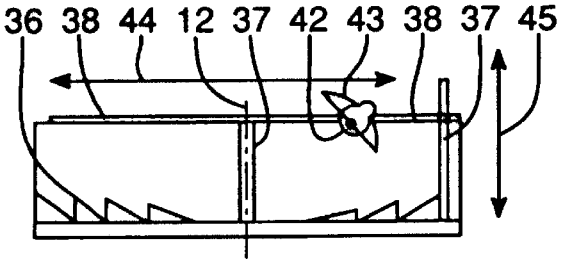
FIG. 20 is a side schematic view of the tenth embodiment of the invention using an echelon reflector.

FIGS. 19 and 20 show another embodiment of this invention of particular interest for making overhead ceiling lights which are adjustable both in the direction they light and in the angle lit, and which have a much higher efficiency than existing lights in the 60 cm×60 cm size range which only light downwards in a non-controllable direction and which have no control over the angle lit.

My invention makes it possible to make such lights which can direct the light either downwards or sideways at an attack angle that can be fixed or variable. And its design also permits the lighting angle to be varied or set as desired.

By using specially designed echelon reflecting elements, it is possible to make such lighting fixtures that can be retro-fitted in the ceilings in spaces presently occupied by known lighting fixtures with fixed lighting characteristics.

It is advantageous to use a lighting fixture made according to my invention, since while being lodged in a fixed position in or on the ceiling, it can light a painting or decoration on the wall next to it. And its angle can be varied in order to light up different size areas. Also if two separate light sources are used, two different such lighting zones can be had and adjusted using just one lighting fixture. Furthermore, the efficiency of these fixtures are far higher than present light fixtures using diffusers in front of the lights.

FIG. 19 is a schematic top view of the fixture. 36 is the main concentrating reflector which can either be concave in form or an echelon reflectors as illustrated here. Should one wish to reduce tooling costs, this echelon reflector can be made up of several smaller sections 41 united together as desired.

Light source 42 (FIG. 20) can be of different types such as an incandescent lamp, fluorescent lamp, discharge lamp, electronic flash, et al. Means are provided to permit its placement at different distances from reflector 36 and at different points as regards the optical axis of the reflector. Thus by selecting a point closer to or further away from reflector 36, one can select the angle lit, and by moving it over different zones of 36, the light can be directed in space as desired. A vertical shaft 37 is shown in a corner of the fixture illustrating one way that can be used to adjust the distance of light source 42 which is shown mounted on lateral bar 38. However, one or more vertical shafts 37 can be placed elsewhere and one or more lateral or radial bars 38 can be used. Lateral or radial bars 38 can be rotated as indicated by arrows R.

FIG. 20 is a schematic cross section view of this version of a device made according to the invention. Arrows 44 show the zone over the echelon reflector 36 where light source 42 can be moved, coupled in this case with reflector 43 to gather light which would not fall on reflector 36. Arrows 45 show how the height of the light source 42 can be selected so as to obtain the desired lighting angle. This angle is increased as the distance 45 is reduced, and the angle is reduced, with a corresponding increase in light output, as the distance is increased up to that of the focal length of the reflector 36.

Light can be reflected sideways away from the optical axis 12 by displacing light source 42 in the opposite direction towards the opposite edge of reflector 36. In order to illuminate reflector 36 more evenly, means are provided to permit light source 42 to be tilted towards the center of reflector 36.

Another embodiment of my invention is of interest principally for lighting cyclorama backgrounds or for front lighting in which two or more fixtures made according to this invention are mounted together with their light being reflected by one or more mirror reflectors common to them all.

Figure 21:
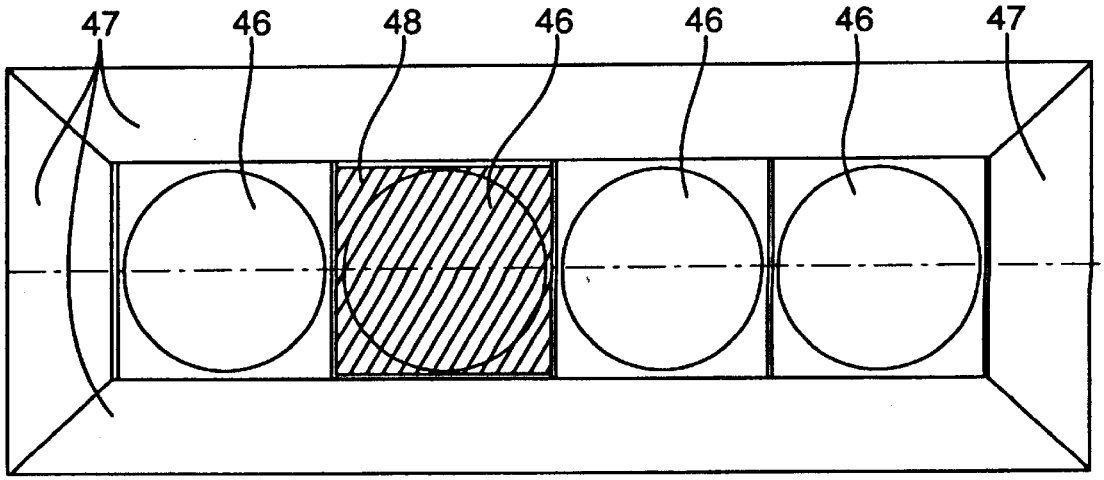
FIG. 21 is a schematic perspective view of the embodiment of the present invention in which four fixtures are placed side-by-side and surrounded by one or more mirror reflecting surfaces.

FIG. 21 is a schematic perspective view of this embodiment of the present invention in which four fixtures 46 made according to this invention are placed side by side and surrounded by one or more mirror reflecting surfaces 47. Other configurations can be used such as square, hexagonal, etc. each light can have its light filtered by color filters 48 placed across its front face.

The mirror surfaces 47 have two roles: they increase light output by capturing and reflecting forward light which would be wasted going to the side. They mix the light coming from all the fixtures 46 since each reflecting surface 47 is a common reflector used jointly by all them all. The mixing together of the light by reflecting surfaces 47 is especially advantageous when lighting backgrounds with red, green and blue light. A common focusing control (not shown) permits the lighting angle of the whole bank of lights to be varied. Also each light can be dimmed separately or together by known means of dimming.

What is claimed is:

1. A lighting device comprising at least two light sources placed in a position to illuminate a concentrating reflector, with adjustable means to orientate said at least two light sources in one or more positions, orientations, or directions with regard to an optical axis of said reflector so as to create and to direct a desired projected pattern of light onto a subject to be illuminated, wherein said adjustable means are tilting means comprising at least one base plate which is separated into different sections, with at least one light source mounted on each section, and in which the respective angles of each section to each other and to the optical axis of the reflector can be varied by said tilting means so as to tilt said at least two light sources in a direction to and from said optical axis of said reflector in a plane substantially perpendicular to said axis.

2. A lighting device comprising:

at least one light source placed in a position to illuminate a main reflector and coupled to a secondary reflector which reflects a portion of its light onto the main reflector, said lighting device having adjustable means to orientate said at least one light source in one or more positions, orientations, and directions with regard to an optical axis of said main reflector;

wherein said main reflector is a concentrating reflector with one ore more portions of a substantially flat, echelon reflector; and said adjustable means are apt to place said at least one light source with respect to the optical axis of said main reflector in a zone away from said optical axis so as to create and to direct a desired projected pattern of light onto a subject to be illuminated.

3. The lighting device as claimed in claim 1, wherein said at least two light sources can be tilted to and from the optical axis up to ±20°.

4. The lighting device as claimed in claim 1, wherein said light sources are mounted in a manner permitting them to be tilted away from said optical axis of said concentrating reflector in a direction towards the reflector and to be held in the desired position.

5. The lighting device as claimed in claim 2 wherein said adjustable means comprise a guide plate having at least one guide slot through which passes an extension of a base of said at least one light source, a cam plate being placed under the guide plate and having at least one cam cooperating with said base, the guide plate and the cam plate being capable of a relative rotating movement so as to displace said base of said light source in said direction to and from the axis of said main reflector.

6. The lighting device as claimed in claim 5, wherein said guide slot of said guide plate is a rectilinear slot extending radially outward from the optical axis of said reflector and said at least one cam of the cam plate is curved.

7. The lighting device as claimed in claim 6, wherein said at least one cam of the cam plate is a slot.

8. The lighting device as claimed in claim 1, wherein said means are tilting means comprising at least one base plate which is separated into different, interconnected or not, sections, with one or more light sources mounted on each section, and in which the respective angles of each section to each other and to the optical axis of the reflector can be varied.

9. The lighting device as claimed in claim 1, wherein said tilting means are controlled by a to and from movement of a shaft connected to one or more of said sections.

10. The lighting device as claimed in claim 1, wherein said tilting means are connected to outer control means for activating said tilting means.

11. The lighting device as claimed in claim 10, wherein said outer control means comprises an arm fixed to the tilting means and extending outside the device in a perpendicular direction to the axis of said reflector.

12. The lighting device as claimed in claim 1, wherein said device comprises at least two light sources of different nature.

13. The lighting device as claimed in claim 1, wherein said light source and said means are placed in interchangeable housings provided with said tilting means.

14. The lighting device as claimed in claim 1, wherein said sections are interconnected.

15. The lighting device as claimed in claim 14, wherein said at least two light sources can be tilted to and from the optical axis up to ±20°.

16. The lighting device as claimed in claim 1, wherein at least two light sources are mounted together on rotating plates so as to rotate the desired light pattern emitted by the lighting device.

17. The lighting device as claimed in claim 14, wherein at least two light sources are mounted together on rotating plates so as to rotate the desired light pattern emitted by the lighting device.

18. The lighting device as claimed in claim 14, wherein said light sources are mounted in a manner permitting them to be tilted away from said optical axis of said concentrating reflector in a direction towards the reflector and to be held in the desired position.

19. The lighting device as claimed in claim 14, wherein said tilting means are connected to outer control means for activating said tilting means.

20. The lighting device as claimed in claim 19, wherein said tilting means are controlled by a to and from movement of a shaft connected to one or more of said sections.

21. The lighting device as claimed in claim 20, wherein said outer control means comprises an arm fixed to the tilting means and extending outside the device in a perpendicular direction to the axis of said reflector.

22. The lighting device as claimed in claim 14, wherein said device comprises at least two light sources of different nature.

23. The lighting device as claimed in claim 14, wherein said light sources and said means are placed in interchangeable housings provided with said tilting means.

24. A lighting device comprising at least one light source placed inside a reflector, a light emitted by the light source being reflected by the reflector so as to create a projected pattern of light to be directed onto a subject to be illuminated, with a focusable light being achieved by shifting means capable of displacing said at least one light source with regard to an optical axis of the reflector, wherein said focusable light being achieved by said shifting means being apt to displace said at least one light source in a direction to and from said optical axis of said reflector, in a plane substantially perpendicular to said axis, so as to change the angle of incidence of the light hitting the reflector, wherein the reflector is a substantially flat, echelon reflector.

25. The lighting device as claimed in claim 24, wherein the echelon reflector is made up of several smaller sections united together.

26. The lighting device as claimed in claim 24, wherein said at least one light source is coupled to a secondary reflector which reflects a portion of its light onto the main reflector.

27. The lighting device as claimed in claim 25, wherein said at least one light source is coupled to a secondary reflector which reflects a portion of its light onto the main reflector.

28. The lighting device as claimed in claim 24, wherein said shifting means are connected to outer control means for activating said shifting means.

29. The lighting device as claimed in claim 25, wherein said shifting means are connected to outer control means for activating said shifting means.

30. The lighting device as claimed in claim 28, wherein said shifting means comprise at least on lateral bar on which said light source is mounted.

31. The lighting device as claimed in claim 29, wherein said shifting means comprises at least on lateral bar on which said light source is mounted.

32. The lighting device as claimed in claim 30, wherein means are provided to permit said light source to be tilted towards the center of the reflector.

33. The lighting device as claimed in claim 31, wherein means are provided to permit said light source to be tilted towards the center of the reflector.

34. The lighting device as claimed in claim 24, wherein said device comprises at least two light sources of different nature.

35. The lighting device as claimed in claim 25, wherein said device comprises at least two light sources of different nature.

36. A lighting device made up of one or more lighting devices as claimed in any of claims 1, 2, 3, 4, 5–11, 12–13 and 14–35 in which the reflectors of said lighting devices are placed contiguously together and used in conjunction with one or more additional, highly reflecting surfaces.

* * * * *